US009410764B2

(12) United States Patent
Jarboe

(10) Patent No.: US 9,410,764 B2
(45) **Date of Patent: *Aug. 9, 2016**

(54) BUTTSTOCK ASSEMBLY

(71) Applicant: RA BRANDS, L.L.C., Madison, NC (US)

(72) Inventor: M. Brent Jarboe, Rineyville, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/466,328

(22) Filed: Aug. 22, 2014

(65) Prior Publication Data

US 2014/0360074 A1 Dec. 11, 2014

Related U.S. Application Data

(62) Division of application No. 13/573,156, filed on Aug. 27, 2012, now Pat. No. 8,844,185.

(51) Int. Cl.

| | |
|---|---|
| ***F41C 23/14*** | (2006.01) |
| ***F41C 23/04*** | (2006.01) |
| ***F41C 23/06*** | (2006.01) |
| ***F41C 23/08*** | (2006.01) |

(52) U.S. Cl.

CPC ..... *F41C 23/14* (2013.01); *F41C 23/04* (2013.01); *F41C 23/06* (2013.01); *F41C 23/08* (2013.01)

(58) Field of Classification Search

CPC ..... F41C 23/04; F41C 23/14; F41C 23/06; F41C 23/08; F41C 27/00

USPC ..... 42/71.01, 72–74, 90, 75.01–75.03

See application file for complete search history.

(56) References Cited

U.S. PATENT DOCUMENTS

| | | | |
|---|---|---|---|
| 543,138 | A | 7/1895 | Murray |
| 1,315,215 | A | 9/1919 | Davidson |
| 1,407,633 | A | 2/1922 | Burton |

(Continued)

FOREIGN PATENT DOCUMENTS

| | | |
|---|---|---|
| CH | 126420 | 6/1928 |
| DE | 1213303 | 3/1966 |

(Continued)

OTHER PUBLICATIONS

"Zweibein im Vorderschaft verschiebbar"; DWJ Deutches Waffen Journal; pp. 878-879; vol. 30, No. 6, Jun. 1, 1994.

(Continued)

*Primary Examiner* — Michael David
(74) *Attorney, Agent, or Firm* — David Sudderth

(57) ABSTRACT

A modular firearm comprising an adjustable modular buttstock assembly. The buttstock assembly can include a frame with a central opening. A comb assembly having a cheek piece and a butt plate assembly having a recoil pad each can be mounted to the frame by an adjustment apparatus. Each adjustment apparatus can include of a guide post and/or a threaded adjustment post each received in respective bores in the frame to adjust the positions of the cheek piece and recoil pad. The adjustment apparatus also can include a locking or engagement feature that can selectively increase the friction between the frame and the guide post and/or adjustment post, to help prevent the translation of the guide post and/or adjustment post in the bore in the frame to fix the comb assembly and butt plate assembly in desired positions with respect to the frame.

12 Claims, 12 Drawing Sheets

(56) References Cited

U.S. PATENT DOCUMENTS 1,651,299 A 11/1927 Stansel
D136,041 S 7/1943 Reising
2,374,621 A 4/1945 Reising
2,787,855 A 4/1957 Guymon
2,895,248 A 7/1959 Sawin
2,900,877 A 8/1959 McClenahan
3,137,958 A 6/1964 Lewis et al.
3,256,632 A 6/1966 Beretta
3,267,601 A 8/1966 Roy
3,348,328 A 10/1967 Roy
3,369,316 A 2/1968 Miller
3,442,042 A 5/1969 Gilbert
3,593,452 A 7/1971 Pekarek
3,798,819 A 3/1974 Hillberg
3,846,928 A 11/1974 Ruger et al.
4,058,922 A 11/1977 Elbe et al.
4,069,414 A 1/1978 Bell
4,098,016 A 7/1978 Foote
4,169,329 A 10/1979 Atchisson
4,220,071 A 9/1980 Seiderman
4,231,177 A 11/1980 Foote
4,327,626 A 5/1982 McQueen
4,430,822 A 2/1984 Fromming et al.
4,515,064 A 5/1985 Hohrein
4,735,007 A 4/1988 Gal
4,766,800 A 8/1988 Miller et al.
4,788,785 A 12/1988 White
5,046,275 A 9/1991 Brown
5,173,564 A 12/1992 Hammond, Jr.
5,209,215 A 5/1993 Morrison
5,228,887 A 7/1993 Mayer
5,305,539 A 4/1994 Von Kuster
5,343,650 A 9/1994 Swan
5,367,812 A 11/1994 Lautrec
5,410,833 A * 5/1995 Paterson ..... F41C 23/06 42/73
5,410,834 A 5/1995 Benton et al.
5,557,872 A 9/1996 Langner
5,711,102 A 1/1998 Plaster et al.
5,778,588 A 7/1998 Allen, III et al.
5,827,992 A 10/1998 Harris et al.
5,900,577 A 5/1999 Robinson et al.
5,933,997 A 8/1999 Barrett
5,970,642 A 10/1999 Martin
6,070,352 A 6/2000 Daigle
6,374,528 B1 4/2002 Davis et al.
6,490,822 B1 12/2002 Swan
6,499,245 B1 12/2002 Swan
6,560,911 B2 5/2003 Sharp
6,591,533 B2 7/2003 Wygant
6,651,371 B2 11/2003 Fitzpatrick et al.
6,688,031 B2 2/2004 Steele
6,732,465 B2 * 5/2004 Strayer ..... F41A 9/40 42/22
6,792,711 B2 9/2004 Battaglia
6,854,206 B2 2/2005 Oz
6,874,267 B2 4/2005 Fitzpatrick et al.
6,895,708 B2 5/2005 Kim et al.
6,901,691 B1 6/2005 Little
6,925,744 B2 8/2005 Kincel
7,121,035 B2 10/2006 Greer
7,152,355 B2 12/2006 Fitzpatrick et al.
7,169,329 B2 * 1/2007 Wong ..... B01J 21/185 252/502
7,220,071 B2 * 5/2007 Baker ..... B41J 3/4075 347/215
7,287,456 B2 10/2007 Spielberger
7,377,066 B2 5/2008 Moore
7,418,797 B1 9/2008 Crose
7,458,179 B2 12/2008 Swan
D590,473 S 4/2009 Fitzpatrick et al.
7,520,083 B2 4/2009 Dextraze
7,523,580 B1 4/2009 Tankersley
D593,633 S 6/2009 Fitzpatrick et al.
D593,634 S 6/2009 Fitzpatrick et al.
D593,635 S 6/2009 Fitzpatrick et al.
D594,083 S 6/2009 Mayberry et al.
D594,084 S 6/2009 Mayberry et al.
7,552,557 B1 6/2009 Mabry
D598,971 S 8/2009 Peterson et al.
7,574,823 B2 8/2009 Nakayama
D600,303 S 9/2009 Fitzpatrick et al.
D600,304 S 9/2009 Fitzpatrick et al.
D600,305 S 9/2009 Fitzpatrick et al.
D600,306 S 9/2009 Fitzpatrick et al.
D600,307 S 9/2009 Fitzpatrick et al.
D600,308 S 9/2009 Fitzpatrick et al.
D600,309 S 9/2009 Fitzpatrick et al.
D600,310 S 9/2009 Fitzpatrick et al.
D600,771 S 9/2009 Fitzpatrick et al.
7,584,567 B1 9/2009 DeSomma et al.
7,640,688 B2 1/2010 Oz
7,673,412 B2 3/2010 Griffin
D613,361 S 4/2010 Peterson et al.
D613,812 S 4/2010 Peterson et al.
7,698,848 B1 4/2010 Bentley
7,762,018 B1 7/2010 Fitzpatrick et al.
7,762,848 B2 * 7/2010 Koetting ..... H01M 2/0212 439/627
7,775,150 B2 8/2010 Hochstrate et al.
D623,718 S 9/2010 Peterson et al.
7,802,392 B2 9/2010 Peterson et al.
7,827,721 B2 11/2010 Griffin
7,845,105 B1 12/2010 Cahill
7,870,689 B2 1/2011 Dextraze
7,930,849 B2 4/2011 Abraham et al.
1,017,386 A1 7/2011 Ingram
7,984,580 B1 7/2011 Giauque et al.
7,987,623 B1 8/2011 Moody et al.
8,028,440 B2 * 10/2011 Sokolowski ..... A43B 1/04 36/45
8,028,459 B2 10/2011 Williams
8,028,460 B2 10/2011 Williams
8,051,594 B2 11/2011 Carr et al.
8,061,072 B1 11/2011 Crose
8,522,465 B2 9/2013 Jarboe et al.
D704,294 S 5/2014 Jarboe
2004/0000083 A1 1/2004 Grant, Jr.
2005/0262752 A1 12/2005 Robinson et al.
2006/0010749 A1 1/2006 Kincel
2006/0026883 A1 2/2006 Hochstrate et al.
2006/0162217 A1 7/2006 Longueira
2006/0236582 A1 10/2006 Lewis et al.
2006/0242880 A1 11/2006 Griffin
2007/0199225 A1 8/2007 Haugen
2007/0236790 A1 10/2007 Turienzo et al.
2008/0000134 A1 1/2008 Peterson
2008/0028662 A1 2/2008 Abraham et al.
2008/0092423 A1 4/2008 Keng
2008/0168695 A1 7/2008 Nakayama
2008/0236016 A1 10/2008 Fitzpatrick et al.
2008/0236017 A1 10/2008 Fitzpatrick et al.
2009/0038198 A1 2/2009 Yu
2009/0101776 A1 4/2009 Peterson et al.
2009/0107022 A1 4/2009 Fitzpatrick et al.
2009/0241397 A1 10/2009 Fitzpatrick et al.
2009/0277066 A1 11/2009 Burt et al.
2009/0288324 A1 11/2009 Peterson et al.
2010/0037505 A1 2/2010 Romer
2010/0180485 A1 7/2010 Cabahug et al.
2010/0192446 A1 * 8/2010 Darian ..... F41C 23/22 42/84
2010/0212205 A1 8/2010 Nill
2010/0212206 A1 * 8/2010 Griffin ..... F41C 23/04 42/73
2010/0251535 A1 10/2010 Keeney et al.
2010/0287809 A1 11/2010 Williams
2011/0061284 A1 3/2011 Cabahug et al.
2011/0099876 A1 5/2011 Bentley
2011/0214328 A1 9/2011 Williams
2011/0283584 A1 11/2011 Walters
2012/0144718 A1 * 6/2012 Danielson ..... F41G 1/35 42/117

(56) References Cited

U.S. PATENT DOCUMENTS

| | | | | |
|---|---|---|---|---|
| 2012/0159828 | A1* | 6/2012 | Jarboe | F41A 3/18 42/16 |
| 2013/0326924 | A1 | 12/2013 | Jarboe et al. | |
| 2014/0075815 | A1* | 3/2014 | Jarboe | F41C 23/04 42/73 |

FOREIGN PATENT DOCUMENTS

| | | |
|---|---|---|
| DE | 3743092 | 7/1988 |
| DE | 68 907 869 | 2/1994 |
| DE | 1225517 | 9/1996 |
| DE | 102007034669 | 1/2009 |
| EP | 0063100 | 10/1982 |
| EP | 1206472 | 10/2003 |
| FR | 419981 | 1/1911 |
| GB | 620188 | 3/1949 |
| GB | 628732 | 9/1949 |
| GB | 937941 | 9/1963 |
| WO | WO 90/10841 | 9/1990 |
| WO | WO 99/05467 | 2/1999 |
| WO | WO 2005/078374 | 8/2005 |
| WO | WO 2008/105960 | 9/2008 |
| WO | WO 2009/061546 | 5/2009 |
| WO | WO 2010-141428 | 12/2010 |
| WO | WO 2014-035831 | 3/2014 |

OTHER PUBLICATIONS

International Search Report dated Nov. 25, 2013 for International Application No. PCT/US2013/056467 filed Aug. 23, 2013.
Written Opinion dated Nov. 25, 2013 for International Application No. PCT/US2013/056467 filed Aug. 23, 2013.
Paulson, A., SRT Shadow Suppressor .338, Special Weapons 2007, pp. 60/63.
Exclusive worldwide license agreements, Feb. 2010, pp. cover-7, ActionSportGames A/S, Denmark.
Prosecution file history for U.S. Appl. No. 61/100,788, filed Sep. 29, 2008.
Technical Specification of APR308 Sniper system, Feb. 2, 2007, 24 pages, Brügger + Thomet, Switzerland.
Gander, T., Unmatched Design, Janes Infantry Weapons, 1997/98, pp. 146/147, 154/157, 186/187, 194/195, 212/213, Twenty-third Edition, Janes Information Group Inc., Alexandri.
AE Users Manual, pp. 1-27, Accuracy International North America, Oak Ridge, TN, 1978.
AW50 Anti Material Sniper Rifle .50 Calibre & Telescopic Sight SuB 3/12×50 MKII 0.2 MRAD, pp. cover/46, Issue 3, Accuracy International North America, Oak Ridge, TN 2003.
Model A W Sniper 7.62×51 Sniper Rifle Users manual, pp. cover-29, Accuracy International Limited, Hampshire, England, 1978.
Operators Manual Long Range Sniper Rifle (:RSR), May 2004, pp. cover, a/d, A/B, I/vi, 0100/1-Index, CHQSoftware.com, Headquarters, Department of the Army.
PGM Precision catalogue, 2007, 18 pages, PGM Precision, Poisy Cedex, France.
Draft Performance Specification: Precision Sniper Rifle, Jun. 11, 2009, pp. 1-32, H92222/09/PSR.
Long Range Precision Rifles, Oct. 4, 2010, 1 page, FNH USA, Inc, http://web.archive.org/web/20031204162037/www.fnhusa.com/contents/r_pgm_6.htm.
A.M.S. Design Nemisis Bolt-Action .50 BMG Rifle, Oct. 4, 2010, pages, Granite Arms, http://web.archive.org/web/20070829231846/http://www.granitearms.com/Nemisis/50BM and al.
Crane, D., LaRue Tactical Stealth OSR (Optimized Shiper Rifle) 7.62mm Sniper Carbine/Rifle, Rifles and Carbines, Nov. 23, 2008, http://www.defensereview.com/larue/tactical.
Operators Manual .50 Caliber Rifle M82A1, pp. cover-33, Barrett Firearms Manufacturing, Inc., Murfreesboro, TN, 2010.
A.M.S.D. Sniper Rifle, Jun. 18, 2004, pp. 1/6 through 6/6, Advanced Military System Design, Geneva, Switzerland.
A.M.S.D. Sniper Rifle, Apr. 21, 2006, pp. 1/6 through 6/6, Advanced Military System Design, Geneva, Switzerland.
OM 50 Owners manual, pp. 1-17, A.M.S.D., Geneva, Switzerland, Dec. 31, 2004.
Sniper Rifles, 2 pages, 2014.
Ultima Ratio Cal. 7.62×51 NATO, 2005, 2 pages, PGM Precision, Poicy Cedex, France.
FN Herstal-PGM 338 User Manual: 338 Lapua Magnum, Nov. 15, 2002, 16 pages, UME/PGM338.doc, PGM Precision, Poisy Cedex, France.
FN Herstal-PGM 338 User Manual: 338 Lapua Magnum, Oct. 14, 2002, 16 pages, UME/PGM338/FNH.doc, FN Herstal.
FN Herstal, PGM Hecate II Manuel de IUtilisateur: 50 BMG-12.7×99mm, 18 pages, UMF/FN/HECATE/II.doc, FN Herstal Jan. 11, 2002.
PGM Hecate II Manuel de IUtilisateur: 50 BMG-12.7×99mm, 18 pages, UMF/PGM/HECATE/II.doc, PGM Precision, Poisy Cedex, France Jan. 11, 2002.
PGM Hecate II Benützer/Handbuch: .50BMG-12.7×99mm, 18 pages, UMG/PGM/HECATE/II.doc, PGM Precision, Poisy Cedes France Jan. 11, 2002.
Hecate II User Manual, pp. cover-28, Version 2.0, PGM Precision, Poisy Cedex, France, 2013.
Hecate II User Manual, pp. cover-28, Version 2.2, PGM Precision, Poisy Cedex, France, 2013.
PGM .338 Lm User Manual, pp. cover-24, Version 2.2, PGM Precision, Poisy Cedex, France, 2013.
Ultima Ratio User Manual, pp. cover-26, Version 2.0, PGM Precision, Poisy Cedex, France, 2013.
Ultima Ratio User Manual, pp. cover-26, Version 2.2, PGM Precision, Poisy-Cedex, France, 2013.
AW338 Sniper Rifle L96 gas Star-Wolf armouries.co.uk, 2008.
Bolt/Action Rifles of the 20th Century, Rick Jamison, Shooting Times (Jan. 2000), 2 pages.
Photographs: Shot Show Exhibit of Folding Stock Firearm (2008 Shot Show), 5 pages.
Adelmann, S., An AE for Accuracy, Shooting Illustrated: Guns and Hunting, pp. 1/4 (Accuracy International 2009).
International Search Report and Written Opinion for PCT/US2010/036838 (Nov. 19, 2010) 27 pages.
Marstar Canada: IMI Galil Galatz Sniper Rifle (Prohibited 12(5)) (Marstar Classic Collectibles)(2007), 3 pages.
Hanlon, M., The Best .338 Sniper Rifle in the World (Gomags RSS Feed—Nov. 26, 2008).
Photograph: Nemisis Rifle, 3 pages, 2011.
Hogg, I., The Worlds Sniping Rifles with Sighting Systems and Ammunition (Greenhill Books, London-Stackpole Books, PA 1998), 12 pages.
Cumpston, M., 21st Century Hunting Rifle, Guns Magazine, May 9, 2012, <http://www.gunsmagazine.com/21st-century-hunting-rifle/>.
Gottfredson, J., More than just steel plates: LaRue Tacticals Stealth Sniper AR-15, Guns Magazine, Aug. 2010, 3 pages, <http://fmgpublications,ipaperus.com/FMGPublications/.
S.H.O.T. Mission Gear Spotlight, Tactical Weapons, May 2009, pp. cover, 88-89, issue #64, Harris Outdoor Group.
Hot Picks from 2009 Shot Show, Guns & Weapons for Law Enforcement, May 2009, 3 pages.
Beckstrand, Tom, Socom PSR Contenders, Tactical Weapons, Jul. 2009, pp. cover, 56-58, 60, 62, issue #68, Harris Outdoor Group.
Trapp, Cory, Ashbury TCR .300 Win Mag, Special Weapons for Military & Police, Apr. 2010, pp. cover, 5-10, issue #87.
Trapp, Cory, Asymmetric Warrior: 338 Lapua Mag, Special Weapons for Military & Police, Aug. 2009, pp. cover, 5-10, 94-95 issue #77.

* cited by examiner

BUTTSTOCK ASSEMBLY

CROSS REFERENCE TO RELATED APPLICATIONS

The present Patent Application is a divisional of U.S. patent application Ser. No. 13/573,156, filed Aug. 27, 2012, by the inventor named in the present Application. This Patent Application claims the benefit of the filing date of the United States Patent Application cited above according to the statutes and rules governing divisional patent applications, particularly 35 U.S.C. §§120 and 121 and 37 C.F.R. §1.78(d)(2) and (d)(3). The specification and drawings of the United States Patent Application referenced above are specifically incorporated herein by reference as if set forth in their entirety.

FIELD OF THE INVENTION

Embodiments of the disclosure are directed generally to firearms and, more particularly, to a modular, adjustable buttstock assembly for a firearm.

BACKGROUND INFORMATION

Most conventional firearms typically are adapted for specific tasks and generally are limited to use with specific calibers and/or types of ammunition. However, demand is increasing for firearms that can be modified to fire different types of ammunition, and/or can be reconfigured for different environments and uses. For example, in military applications today, the environments in which soldiers are forced to fight are changing such that they can be in open desert and then move into close quarters battle in a more urban area within the matter of a few hours. At the same time, their weapons needs can further change, i.e., they might be faced with need for a longer range, sniping weapon or alternatively with needs for a more standard infantry rifle depending on the environment or situation. Carrying multiple different firearms is, however, impractical as adding undue weight and bulk to soldiers' packs and gear. Also, for more specialized uses, such as for sniping and other tactical situations, the weapon must be configurable as needed to fit the shooter's particular needs and/or use in a particular combat situation.

In addition, in operation of generally all types of firearms, the force of the expanding gas propelling a bullet/shot down the barrel upon firing also will force the firearm rearwardly in a recoil action. Accordingly, most rifles, shotguns, and similar types of firearms subject to a substantial recoil typically will include a buttstock for engaging the shooter's shoulder when firing the firearm to help support the firearm during a recoil action. It is becoming increasingly desirable that the buttstocks of such firearms accommodate different morphologies, comfort preferences, and other variables of different users, as well as supporting various equipment that may be used in conjunction with the firearm. It is also desirable, however, to minimize the overall weight of a firearm in military and civilian sporting applications. In addition, changes to features of the buttstock may be required in the field. For example, a user may want to adjust features of the buttstock to accommodate changes to the optics, caliber of ammunition, and/or barrel length of the firearm. It is desirable that such changes be able to be made in the field without requiring that a user carry additional tools, and that the changes can be made quickly and easily without compromising the performance of the buttstock during recoil.

Accordingly, it can be seen that a need exists for a buttstock apparatus for firearms that addresses the foregoing and other related and unrelated problems in the art.

SUMMARY OF THE DISCLOSURE

The present disclosure generally is related to a modular firearm comprising an adjustable, modular buttstock assembly. The buttstock assembly generally can be moveable between an extended position for placing the firearm in an operating configuration and a folded position for placing the firearm in a transport configuration. The buttstock assembly can include a frame with a central opening and at least one of a comb assembly with a cheek piece and a butt plate assembly having a recoil pad mounted to the frame by an adjustment apparatus. Each adjustment apparatus can include at least one of a guide post and a threaded adjustment post, each received in respective bores in the frame. The adjustment apparatus can include a feature that can selectively increase the friction between the frame and the guide post and adjustment post to help prevent the translation of the guide post and adjustment post in the bore in the frame. For example, a clamping mechanism, such as a toggle lock, a screw clamp apparatus, slide locking mechanism, or other releasable lock mechanism can be mounted to the frame at or proximate the bores in the frame receiving the guide post and adjustment post. In one example embodiment, the clamping mechanism can compress or clamp the bores into frictional engagement with the guide post and adjustment post, squeezing the guide post and adjustment post in the frame to secure the recoil pad and cheek piece in desired positions.

In one embodiment, the vertical position of the recoil pad further can be selectively adjusted. The butt plate assembly can include a base plate slidably coupled to a guide plate (e.g., with tongue and groove features). The guide plate, for example, can include an adjustment mechanism, such as a detent assembly that can selectively engage a notch of a series of notches in the base plate for selectively preventing or allowing vertical translation of the base plate relative to the guide plate. In one embodiment, the clamp mechanism is biased into engagement with the notch.

Features for attaching accessories to the buttstock assembly also can be mounted to the frame. For example, one or more accessory rails can be mounted to the frame via an adjustable bracket, or can be directly secured to a portion of the frame. Additionally, the frame can include features for attaching a sling swivel, or other similar features.

Those skilled in the art will appreciate the above features and advantages, as well as additional features and advantages upon reading the following detailed description with reference to the accompanying drawings and appendix.

Figure 1A:
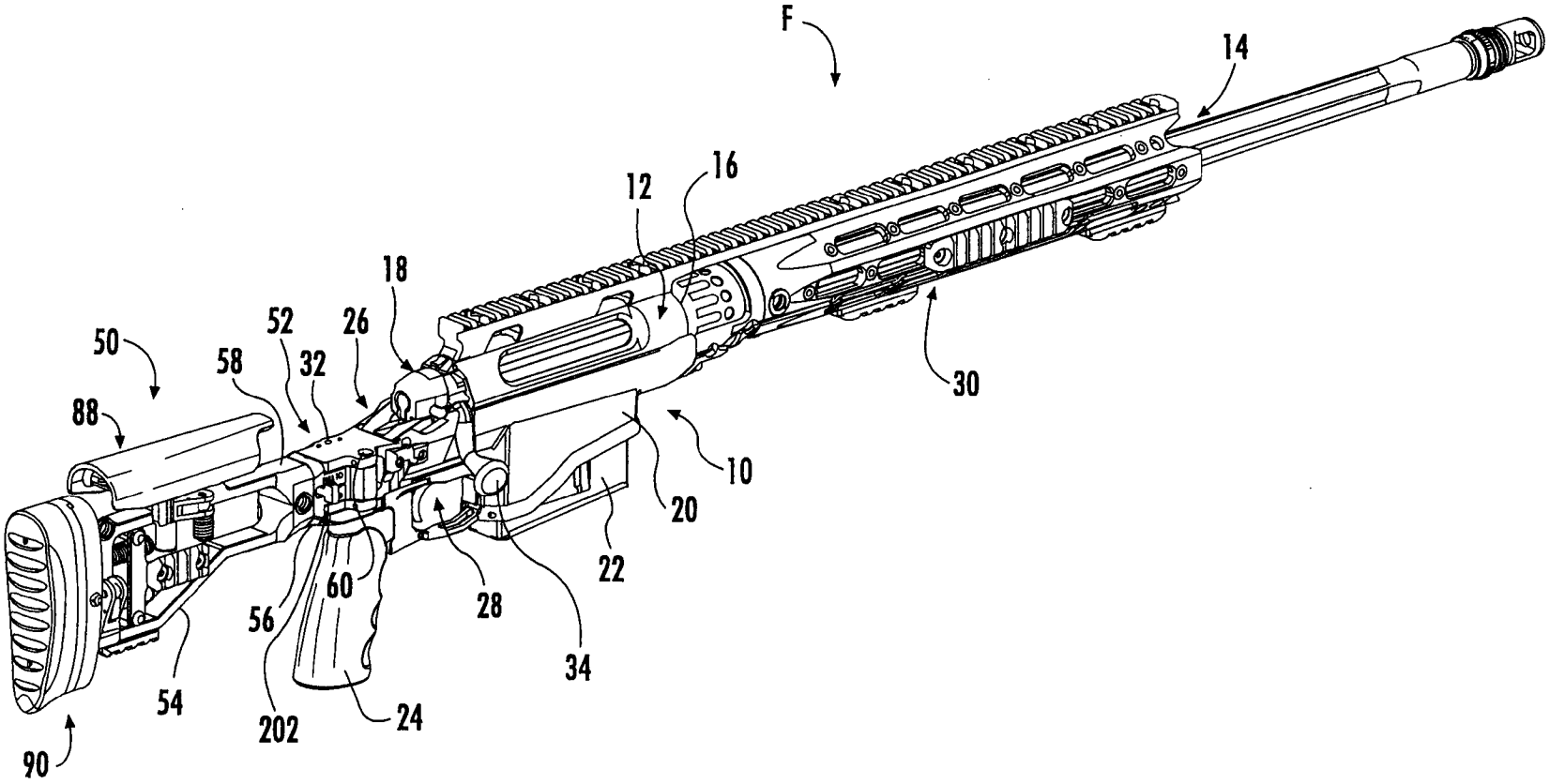
FIGS. 1A-1B are isometric views of a firearm with a buttstock assembly according a first exemplary embodiment of the disclosure, the buttstock assembly shown in extended and folded positions.

Those skilled in the art will appreciate and understand that, according to common practice, the various features of the drawings discussed below are not necessarily drawn to scale, and that dimensions of various features and elements of the drawings may be expanded or reduced to more clearly illustrate the embodiments of the present invention described herein.

DETAILED DESCRIPTION OF THE EXEMPLARY EMBODIMENTS

Referring now to the drawings in which like numerals indicate like parts throughout the several views, the figures illustrate example embodiments of the buttstock apparatus according to the principles of the present disclosure for use in a firearm such as a precision sniper rifle (PSR), modular sniper rifle (MSR), and/or similar types of firearms. However, it will be understood that the principles of the buttstock apparatus of the present disclosure can be used in various types of firearms including M4, M16, AR-15, SCAR, AK-47, HK416, ACR, shotguns, rifles and other long guns, hand guns, and other gas-operated semi-automatic, automatic and manually operable firearms. The illustrated embodiments, include by way of example, shows a bolt action firearm. However, the present disclosure should not be limited to the illustrated examples.

The following description is provided as an enabling teaching of exemplary embodiments, and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof.

As shown in FIG. 1A, the firearm F generally includes a frame or chassis 10 including a receiver 12 and a barrel assembly 14 mounted to the receiver 12 at a front end 16 of the chassis 10 and defining a chamber at a position where the barrel assembly 14 connects to the receiver 12. A bolt assembly 18 generally is slidably received in the receiver 12 for operation of the firearm F. A magazine well 20 is defined in the chassis 10 and in communication with the chamber, and an ammunition magazine 22 will be received in the magazine well 20 for supplying ammunition to the receiver 12. A pistol-style handgrip 24 also can be connected to the chassis 10 adjacent a rear end 26 of the chassis 10. A fire control 28 is mounted to the chassis 10 for controlling firing of the firearm F. A modular handguard assembly 30 further can be located along the front portion of the chassis 10 to assist in gripping and holding the firearm F.

Figure 1B:
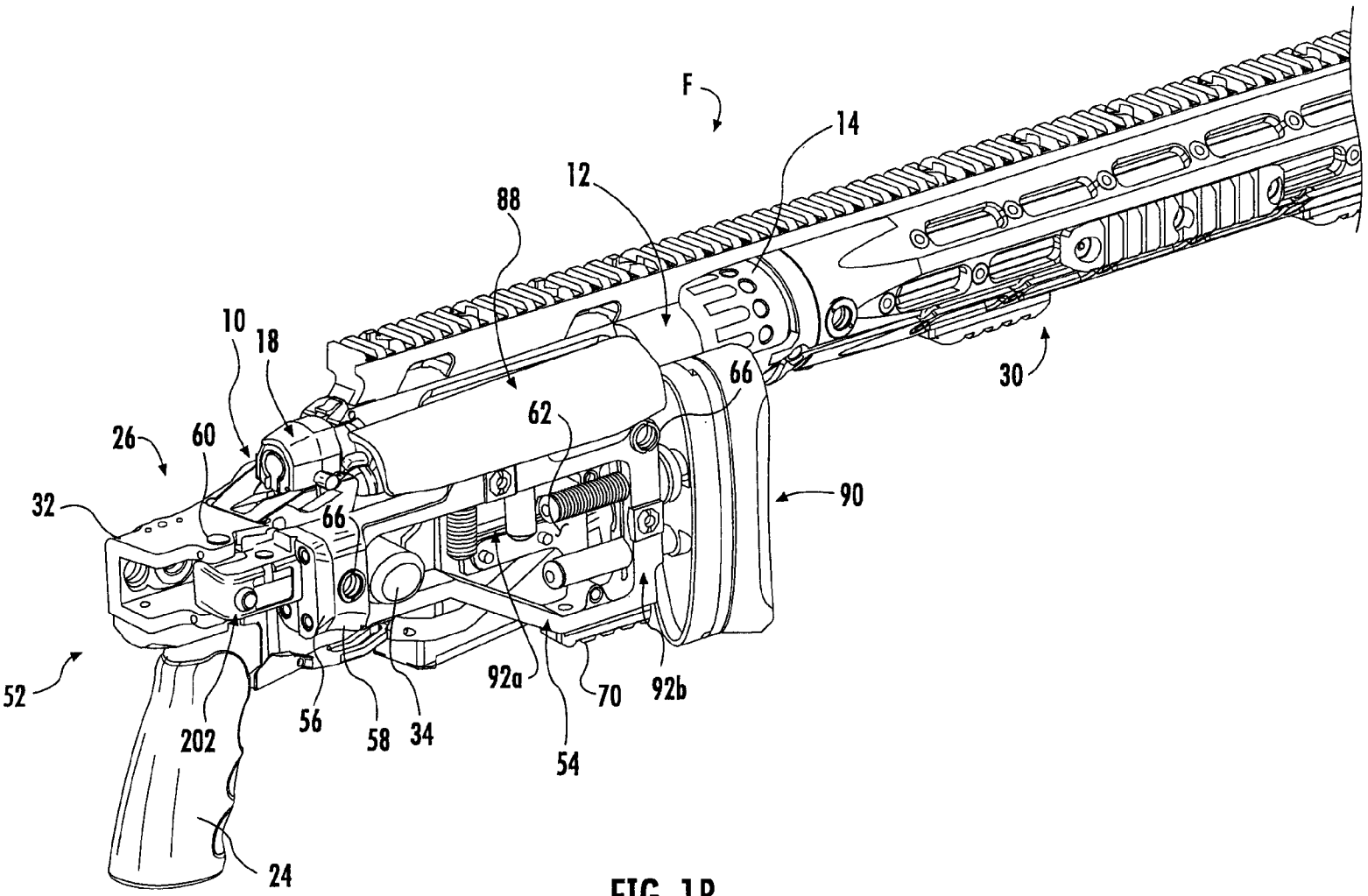
Figure 2A:
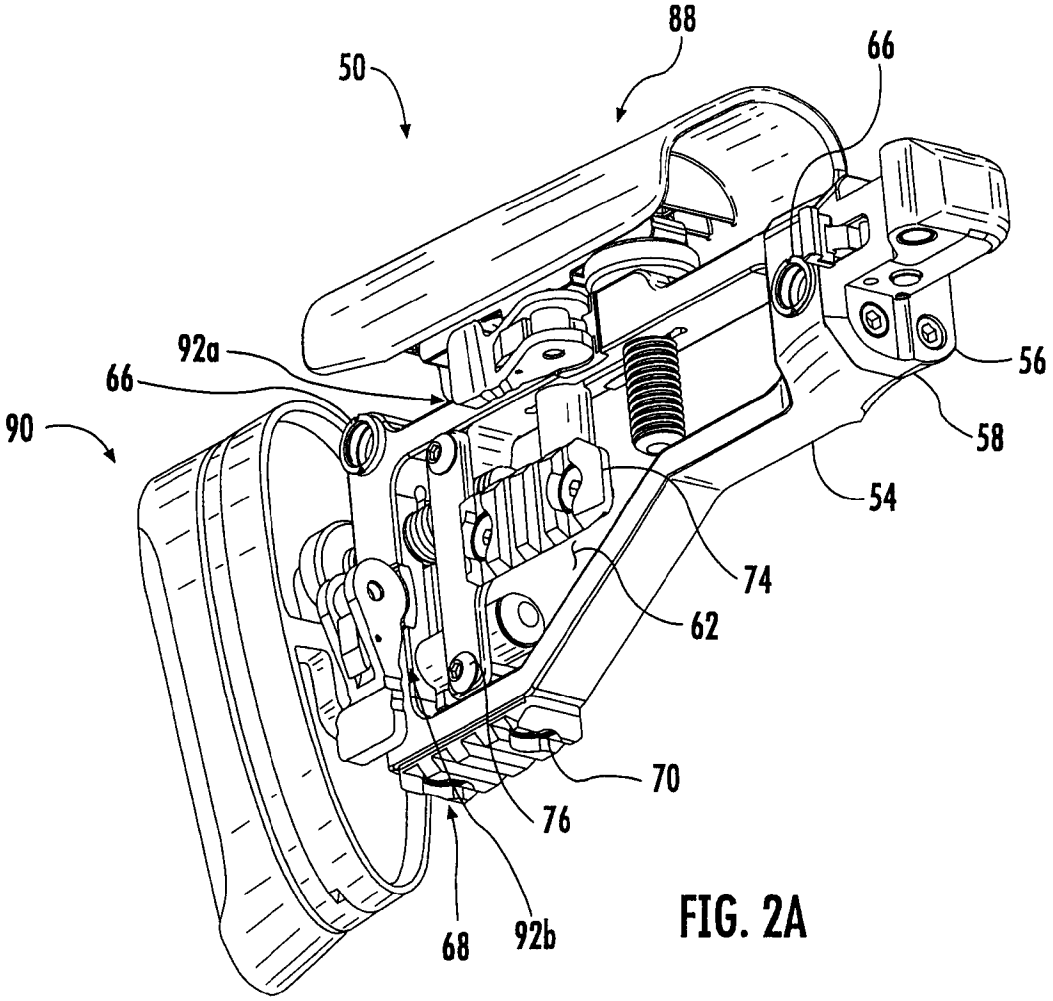
FIGS. 2A and 2B are isometric views of the buttstock assembly of FIGS. 1A-1B.
Figure 2B:
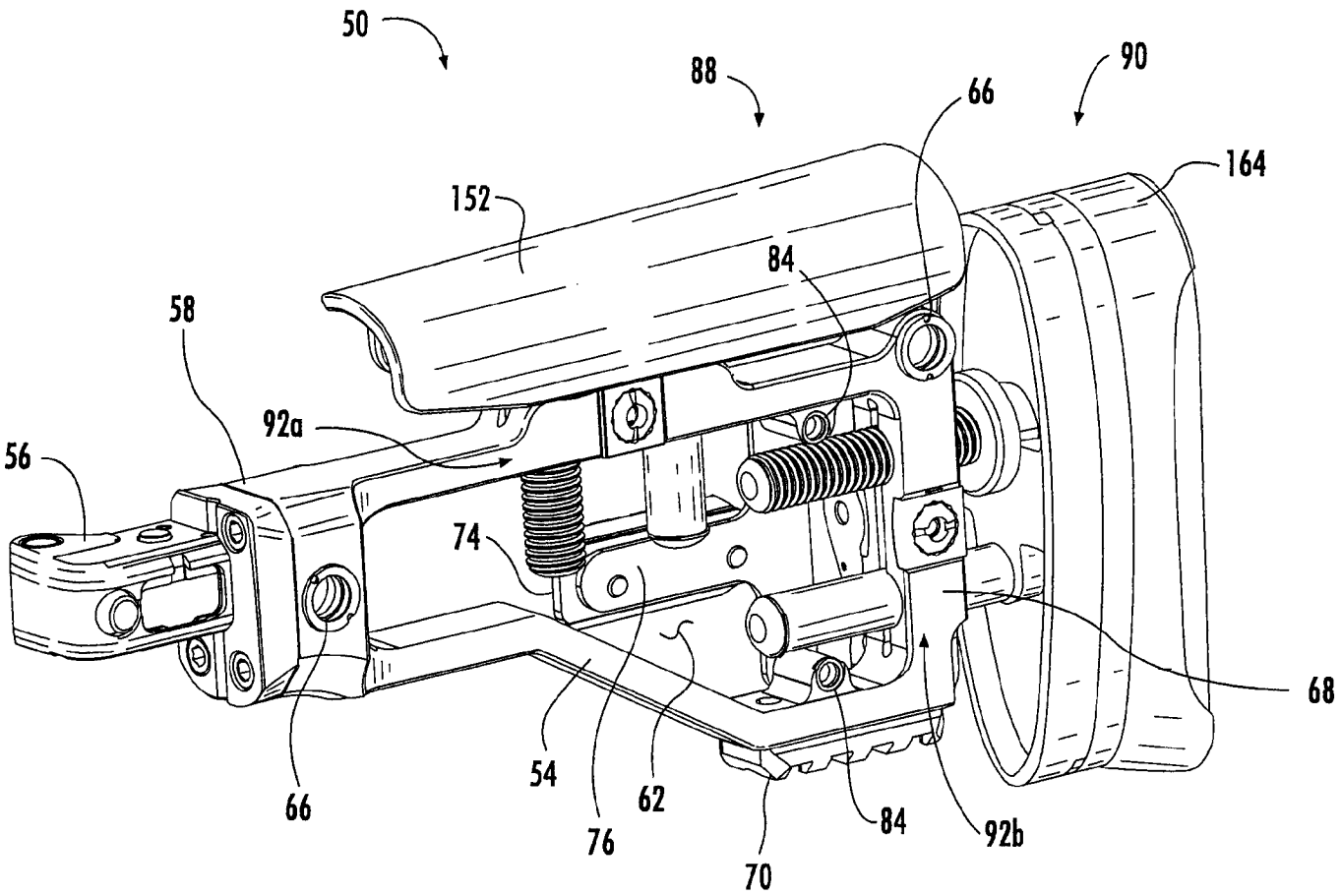

In the illustrated embodiment, a buttstock assembly 50 is mounted to the rear end 26 of the chassis 10 at a hinge 52. FIG. 1A shows the firearm F in a shooting configuration with the butt stock assembly 50 in an extended position, in line with the chassis 10, with its hinge blocked or the buttstock assembly otherwise fixed against further pivoting movement. FIG. 1B shows the buttstock assembly in a folded position, pivoted forwardly toward the receiver. As illustrated in FIGS. 2A and 2B, the buttstock assembly 50 includes a skeletonized body or frame 54, and a hinge member 56 connected to a front end 58 of the frame 54 (e.g., by screws). The hinge member 56 is pivotally connected to hinge bracket 32 at the rear end 26 of the firearm chassis 10 by a hinge pin 60 (FIGS. 1A-1B).

Figure 3:
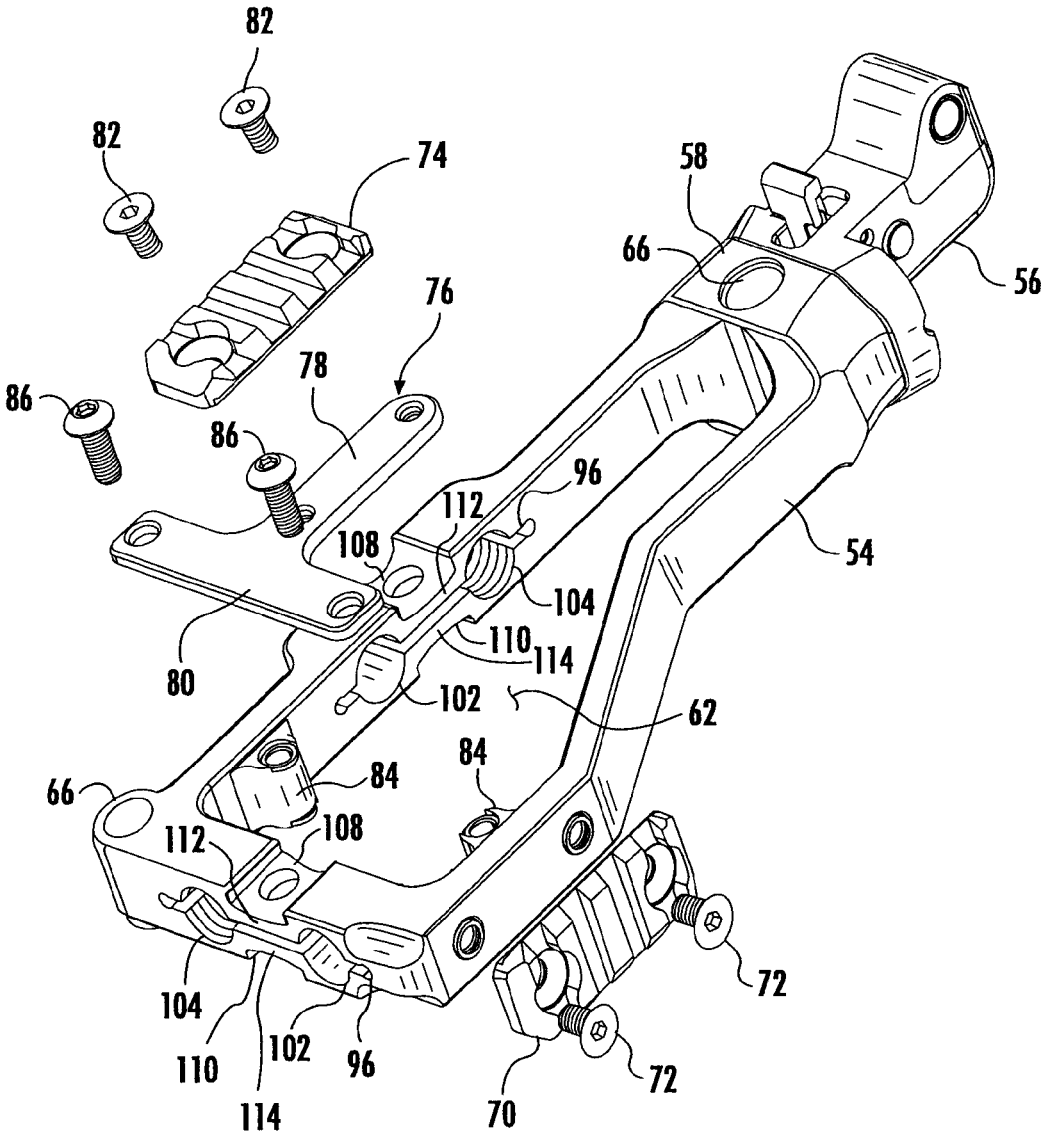
FIG. 3 is an isometric, exploded view of a frame and accessory rail features of the buttstock assembly of FIGS. 1A-1B.

As shown in FIG. 3, the frame 54 of the buttstock assembly has a reduced mass and/or surface area, defining a central open area or open space therein 62. The shape of the frame 54 can provide a suitable structure for transferring the force of the recoil to the butt plate assembly (described below) without compromising the integrity of the buttstock assembly 50. In addition, the central open space 62 helps to reduce the mass and weight of the buttstock assembly 50, which helps reduce the overall weight of the firearm F. The frame 54 can be made of a light-weight, high strength material (e.g., aluminum, magnesium, steel, other metals and metal alloys, polymers, carbon fiber, etc.), or any other suitable material. The frame 54 also can include one or more sling bores 66, which can be formed at different locations along the frame, for example at the front end 58 and a rear end 68, respectively, of the frame as shown in FIGS. 2A-3, for attaching a sling swivel (not shown) or other features for securing a sling (not shown), for example, to the firearm F (FIGS. 1A-1B). In one embodiment, the frame 54 can be formed as an at least partially solid section or unitary piece of material extending around the central opening 62. Alternatively, at least a portion of the frame 54 can comprise a hollow tube extending at least partially around the central opening 62, with a channel such as for routing of wires, etc. . . . , formed therethrough. The frame 54 further can be otherwise configured or portions thereof omitted without departing from the scope of the disclosure.

As shown in FIGS. 2A, 2B, and 3, a bottom accessory rail 70 (e.g., Picatinny rail) can be secured to the bottom of the frame 54, such as by screws 72 or other fasteners so that the bottom accessory rail 70 can be removed or replaced. Additionally, a side accessory rail 74 (e.g., Picatinny rail) can be secured to the frame 54 via a bracket 76. In the illustrated embodiment, the bracket 76 is generally T-shaped with a longitudinal portion 78 (e.g., generally parallel to the barrel) and a vertical portion 80. The side accessory rail 74 can be secured to the longitudinal portion 78, such as by screws 82 or other fasteners so that the side accessory rail 74 can be removed or replaced.

As shown in FIG. 3, the frame 54 can include two or more protuberances 84 extending into central opening 62 of the frame, with the vertical portion 80 of the bracket 76 being secured to the protuberances 84, such as by fasteners 86. In one embodiment, the vertical faces of the protuberances 84 can be inset or spaced apart from the sides of the frame 54 so that the thickness of the bracket 76 is at least partially disposed in the central opening 62 of the frame. The protuberances 84 and the bracket 76 also can be generally symmetric so that the bracket 76 can be mountable in varying orientations and/or on either side of the frame 54. Accordingly, the side accessory rail 74 can be ambidextrously positioned for use by either a right- or left-handed shooter.

In an alternative embodiment, the bottom accessory rail 70 and/or the bracket 76 could be riveted or adhered to the frame 54 or integrally formed with the frame, and the side accessory rail 74 could be riveted or adhered to or integrally formed with the bracket 76. In another alternative embodiment, an accessory rail or other attachment feature can be secured to any surface of the frame 54, and could be provided with a variety of configurations or omitted, without departing from the disclosure.

Figure 4:
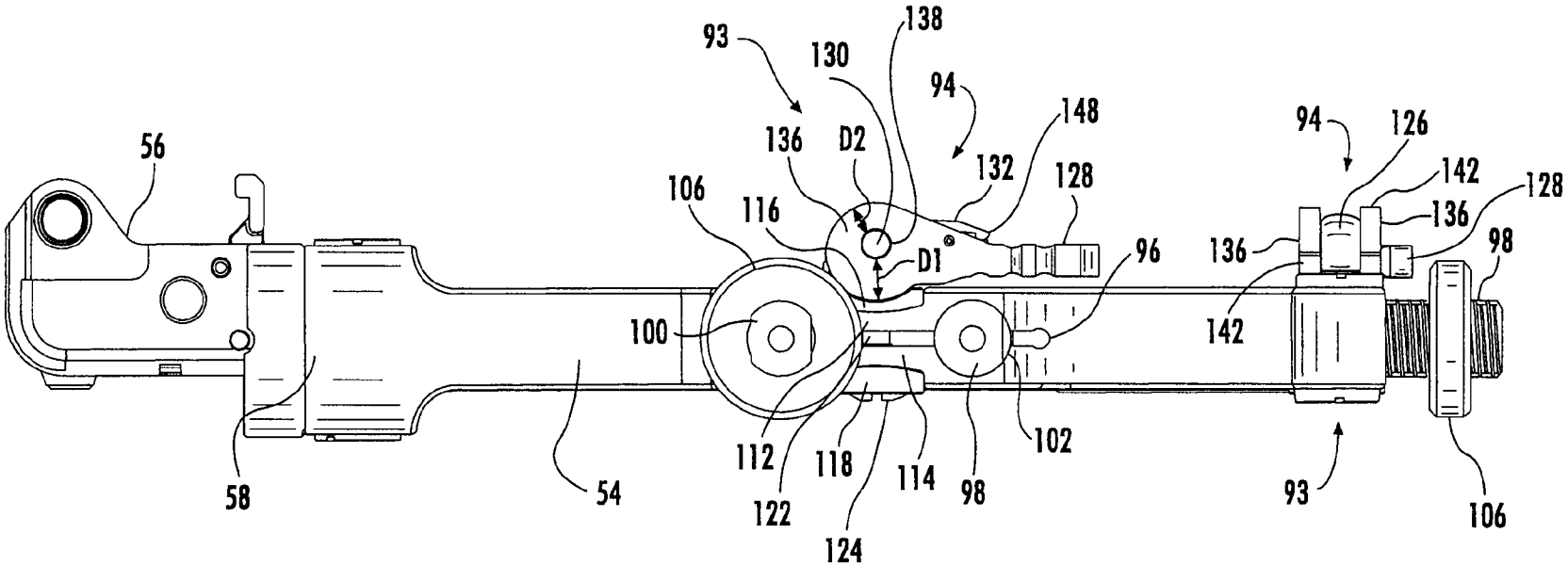
FIG. 4 is a top view of the frame and adjustment features of the buttstock assembly of FIGS. 1A-1B.
Figure 5:
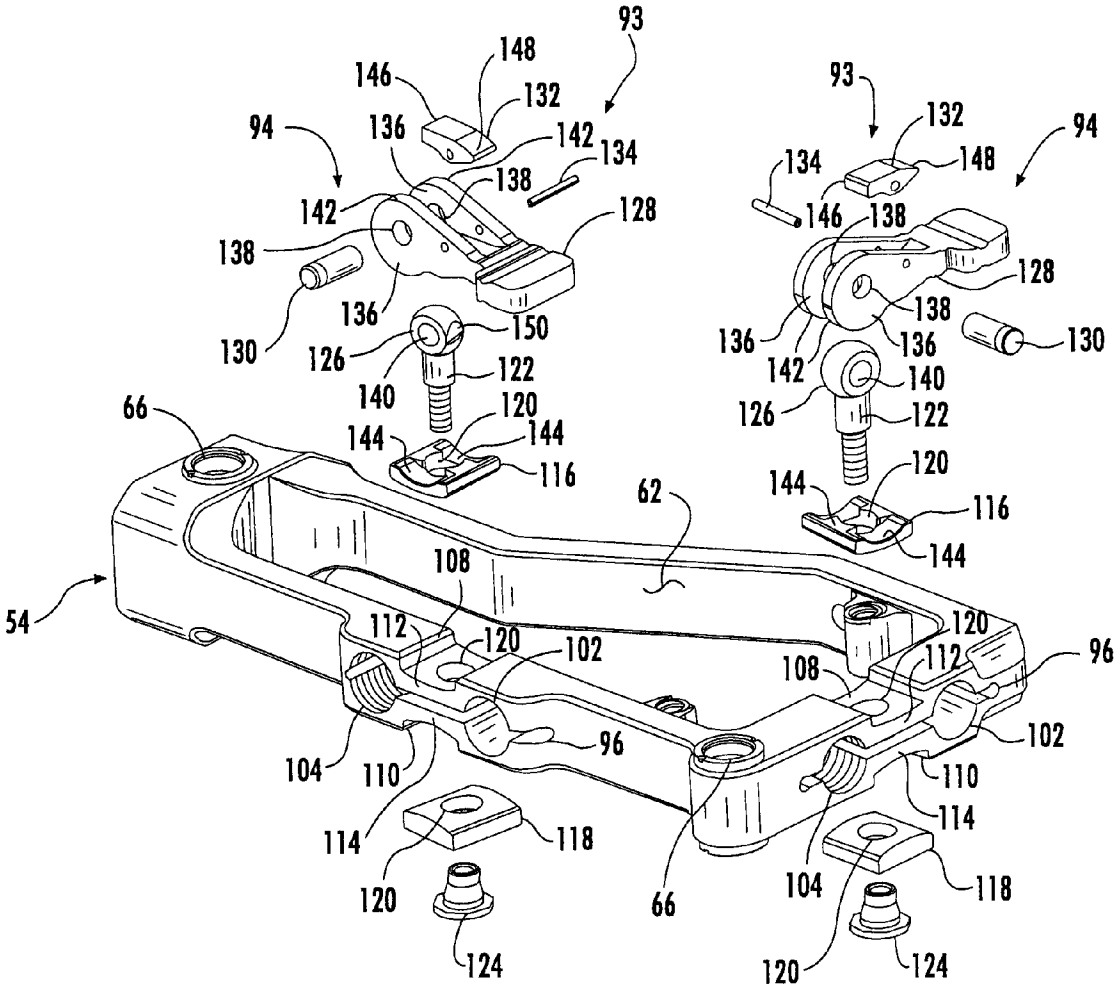
FIG. 5 is an isometric, exploded view of the frame and the adjustment features of FIG. 4.

In the illustrated embodiment, as shown in FIGS. 1A-1B, the buttstock assembly 50 can include a comb assembly 88 and a butt plate/recoil pad assembly 90, each coupled to the frame 54 by a respective adjustment apparatus 92*a*, 92*b* (FIGS. 2A and 2B). As shown in FIGS. 4 and 5, each of the adjustment apparatus 92*a*, 92*b* generally includes a lock mechanism 93, which can include clamping mechanism such as a toggle lock, slide lock, screw clamp, set screw, or other, similar lock/clamping mechanism. In the illustrated embodiment, a throw lever assembly 94 is shown attached to the frame in a position oriented transverse to a slit or separation channel 96 cut through the frame. A guide post 98 and a threaded adjustment post 100 (FIG. 6A) further are received in respective through-bores 102, 104 in the frame for each adjustment apparatus 92*a*, 92*b*. The bores 102, 104 are coextensive with the slits or separation channels 96, and one of the bores 102/104, i.e., bore 104 can be internally threaded for engagement with the external threads of the adjustment post 100. An adjustment wheel 106 can be attached to each of the adjustment posts 100 so that a user can grip the adjustment wheel 106 to screw the adjustment post into and out of the central opening 62 of the frame 54. Relief cuts 108, 110 (FIG. 5) can be formed on respective sides of the frame 54, centered on each of the slits 96. Accordingly, a deflection portion 112 of the frame is defined between each slit 96 and respective relief cut 108, and a deflection portion 114 of the frame is defined between each slit 96 and respective relief cut 110 so that the deflection portions 112, 114 are spaced apart from one another by the portion of the slit 96 between the bores 102, 104.

In the illustrated embodiment, the deflection portions 112, 114 can be squeezed or clamped toward one another, pivoting at the ends of the slit 96, to reduce the width of the slit 96 and thereby reduce the diameters of one or both of the bores 102, 104. Accordingly, the frame 54 is tightened around the guide post 98 and/or the adjustment post 100 at the bores 102, 104 to help prevent translation of the guide post and/or the adjustment post relative to the frame. Relieving the clamping of the deflection portions 112, 114 will allow the guide post and/or adjustment post to translate relative to the frame so that the positioning of the comb assembly 88 and the butt plate assembly 90 can be adjusted.

In the illustrated embodiment, the throw lever assemblies 94 generally form toggle clamps mounted to or adjacent the deflection portions 112, 114, typically being oriented transverse to the slits 96. As shown in FIGS. 4 and 5, each of the throw lever assemblies 94 includes a lever lock plate 116 disposed in the respective relief cut 108 and a locking nut plate 118 disposed in the respective relief cut 110. Each of the lever lock plate 116 and the locking nut plate 118 includes a through bore that is aligned with through bores formed in the deflection portions 112, 114 of the frame 54 to form a through bore 120 that receives a cross pin 122 of the respective throw lever assembly 94. A nut 124 or other fastener can be at least partially received in the locking nut plate 118 to threadedly engage the cross pin 122 and thereby secure the cross pin to the frame 54 with the lever lock plate 116 and locking nut plate 118 secured between the head 126 of the cross pin 122 and the nut 124.

A thumb tab or lever 128 is pivotably coupled to the head 126 of the cross pin 122 by a pivot pin 130, and a lever lock 132 is pivotably coupled to the thumb tab 128 by a pivot pin 134. The thumb tab 128 includes cam lobes 136 disposed on either side of the head 126 of the cross pin 122, and an off-center bore 138 extends through each of the cam lobes 136. The bore 138 is aligned with a bore 140 in the head 126 so that the pivot pin 130 can extend through the bores 138, 140. Accordingly, the thumb tab 128 can pivot relative to the cross pin 122 about the pivot pin 130. The cam lobes 136 include cam surfaces 142, which can engage corresponding indentations or surfaces 144 in the lever lock plate 116 so that the cam surfaces 142 can slide or pivot over the surface of the lever lock plate 116. The cam lobes 136 also generally are configured so that when the thumb tab 128 is in the release position (e.g., when the thumb tab is pivoted away from the frame 54), the pivot pin 130 is closer to the lever lock plate 116 than when the thumb tab 128 is in the lock position (e.g., when the thumb tab is disposed against the frame 54). Stated another way, the distance D1 (FIG. 4) between the pivot pin 130 and the portion of the cam surfaces 142 in contact with the lever lock plate 116 when the thumb tab 128 is in its locking position is larger than the distance D2 (FIG. 4) between the pivot pin 130 and the portion of the cam surfaces 142 in contact with the lever lock plate 116 when the thumb tab 128 is in its opened or release position. Accordingly, when the thumb tab 128 is in its locking position (e.g., FIG. 4), the cam lobes 136 push or bear against the indentations 144 of the lever lock plate 116 and move the cross pin 122 via the pivot pin 130 against the nut 124. The cam lobes 136 and the nut 124 accordingly bear against the respective lever lock plate 116 and locking nut plate 118, urging the deflection portions 112, 114 toward one another, at least partially closing the slit 96. As a result, the frame 54 is placed into frictional engagement with the adjustment apparatus of the comb assembly and/or butt plate assembly including the actuated throw lever assembly, as the bores 102, 104 are closed/tightened around the respective guide post 98 and/or the adjustment post 100 to clamp the guide post and adjustment post in place.

As shown in FIG. 5, the lever lock 132 includes a lock end 146 and an actuating end 148. The lock end 146 can be biased downwardly to engage a notch 150 in the head 126 of the cross pin 122 by a spring (not shown) engaging the pivot pin 134 and the lever lock 132. The lever lock 132 can be aligned so that pulling up on the thumb tab 128 will urge the lock end 146 against the notch 150, and the lever lock 132 will resist pivoting of the thumb tab. Pushing downwardly on the actuating end 148 will pivot the lock end 146 upwardly against the spring bias and out of the notch 150, and the thumb tab 128 can be pivoted upwardly. After the thumb tab 128 pivots a short distance, its actuating end 148 can be released, and the lever lock 132 will be pivoted so that the lock end 146 contacts the curved outer surface of the head 126 of the cross pin 122. The lock end 146 further will slide along the outer surface of the head 126 as the thumb tab 128 continues to pivot to the release position. As the thumb tab 128 is moved into the lock position, the lock end 146 will engage the notch 150 to lock the thumb tab in position. The thumb tab 128 and the lever lock 132 can be otherwise configured or omitted without departing from the disclosure.

In the illustrated embodiment, the relief cuts 108, 110 are generally substantially identical in size and/or configuration, enabling the throw lever assemblies 94 to be easily reconfigured for ambidextrous use by either right- or left-handed users. Accordingly, while the throw lever assemblies 94 are assembled with the thumb tabs or levers 128 on the right side of the firearm F in FIGS. 1A, 2A, 2B, 4, and 5, the lever lock plate 116 and the locking nut plate 118 can be switched so that the lever lock plate 116 is on the left side of the firearm and the locking nut plate 118 is on the right side of the firearm. The thumb tabs 128 thus can be disposed on the left side of the firearm, engaged with the lever lock plate 116, and the cross pin 122 can be inserted into the through bore 120 from the left side of the firearm to engage the nut 124 on the right side of the firearm. The throw lever assemblies 94 can be otherwise configured or omitted without departing from the disclosure.

It will also be understood by those skilled in the art that the adjustment apparatus 92*a*, 92*b* can be otherwise configured and/or features thereof can be modified or omitted without departing from the disclosure. For example, the guide post 98 or the adjustment post 100 could be omitted for one or both of the adjustment apparatus 92*a*, 92*b*. While the comb assembly 88 or the butt plate assembly 90 could be supported by the respective guide post 98 alone when the guide posts 98 are clamped to the frame 54 by the throw lever assemblies 94, the adjustment posts 100 can provide additional support to the clamping of the throw lever assemblies 94 by the threaded engagement of the adjustment posts 100 with the frame 54 at the bores 104 whether the guide posts 98 are included or omitted.

Figure 7A:
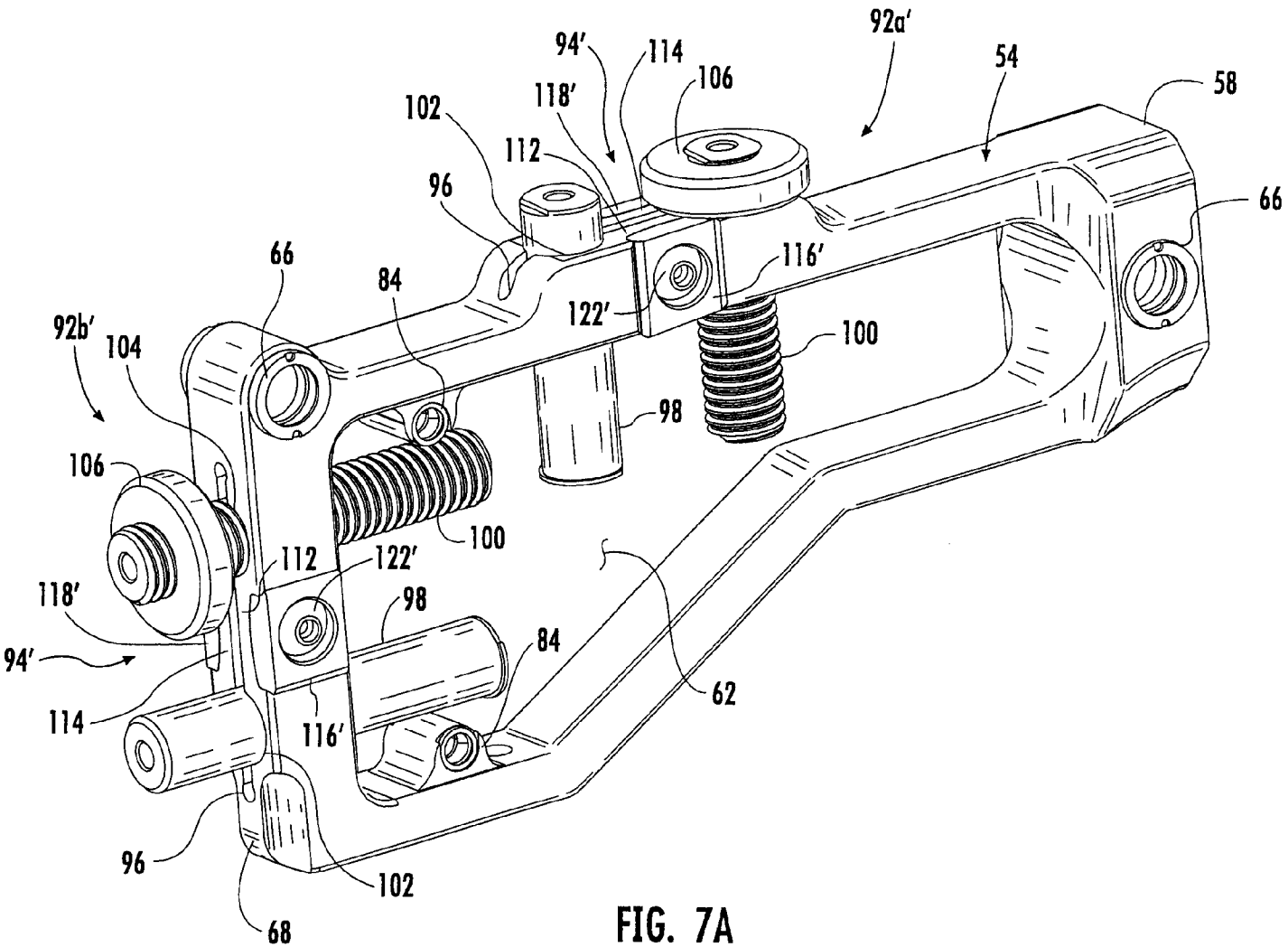
FIGS. 7A and 7B are isometric views of the frame and adjustment features of a buttstock assembly according to another exemplary embodiment of the disclosure.
Figure 7B:
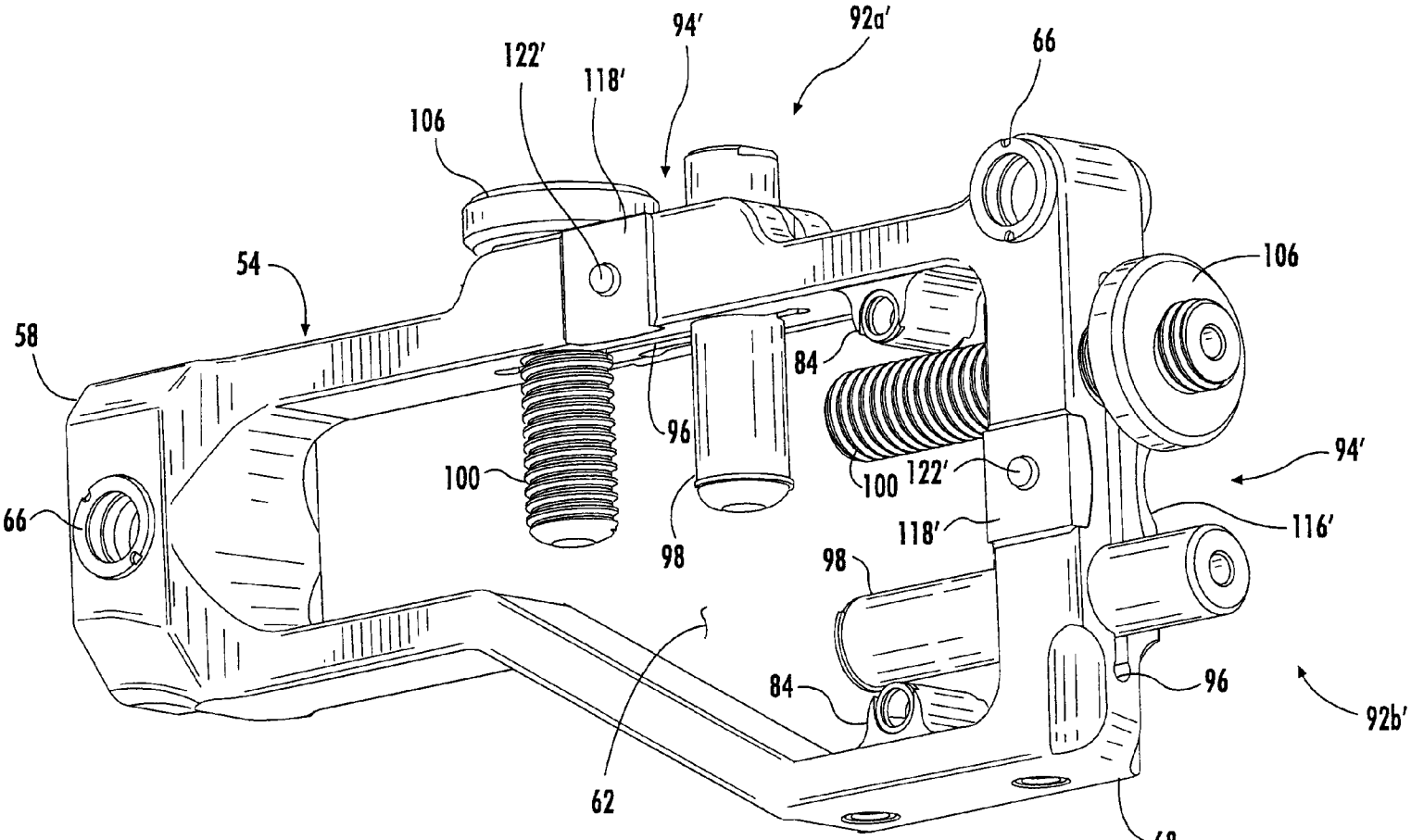

In an alternative embodiment, the adjustment features 92*a*, 92*b* can include any suitable apparatus that squeezes or clamps the guide post 98 and/or the adjustment post 100 in the frame 54 or otherwise increases or protrudes a frictional engagement between the frame 54 and the guide post 98 and/or the adjustment post 100 to help prevent the guide post 98 and/or the adjustment post 100 from moving relative the frame 54. For example, a slide lock or twist lock clamping mechanism could be used in place of the throw lever assemblies 94 (FIGS. 1A-5) or the screw clamp assemblies 94' (FIGS. 7A and 7B).

Figure 6A:
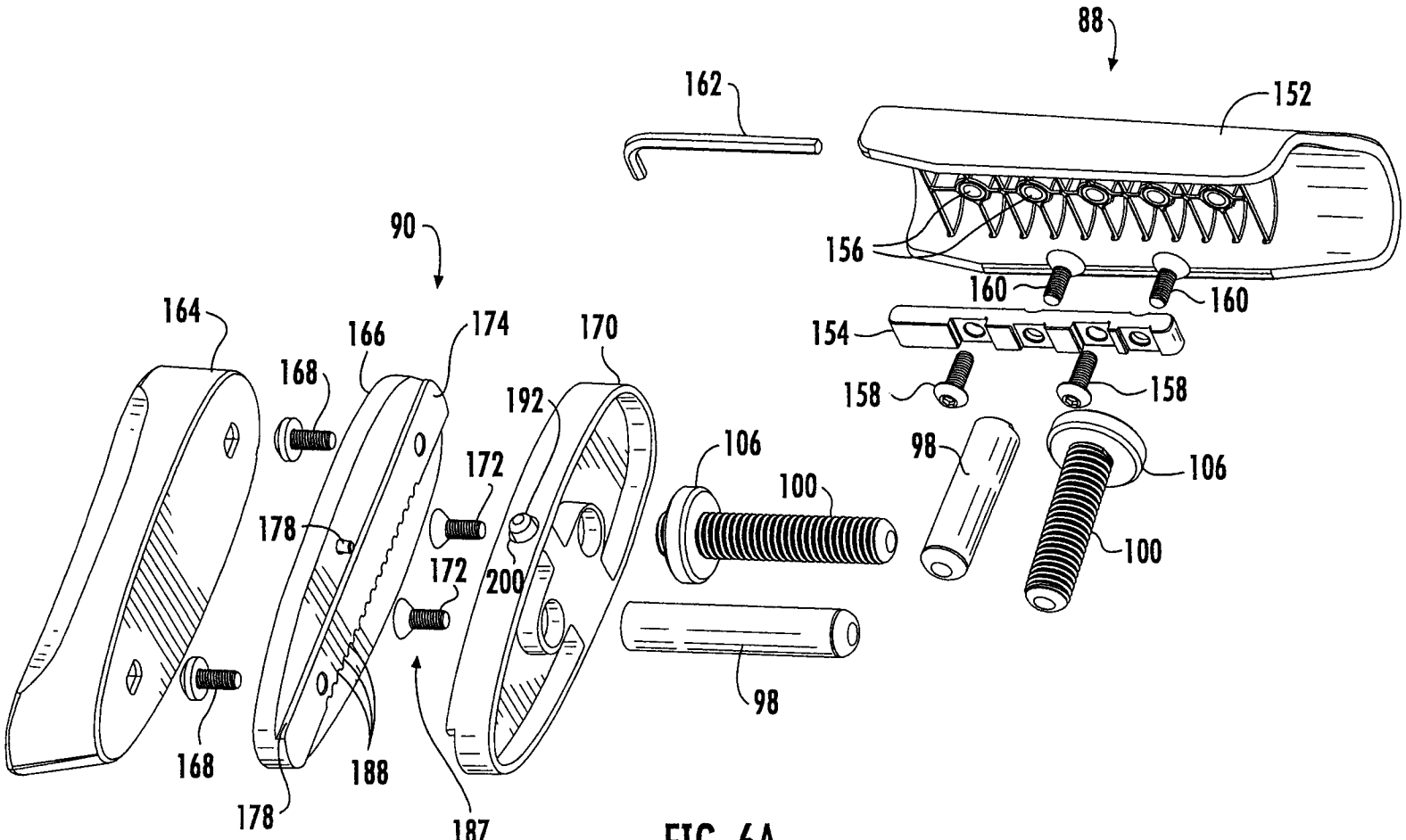
FIG. 6A is an isometric, exploded view of a butt plate assembly and a comb assembly of the buttstock assembly of FIGS. 1A-1B.

As shown in FIG. 6A, the comb assembly 88 includes a cheek piece 152 and a comb mounting bracket 154. A user can rest his or her cheek against the cheek piece 152 when using optics (not shown) or other features associated with the firearm F. The cheek piece 152 can be made of a polymer, synthetics, rubber, or other materials that are comfortable for the user (e.g., a resilient cushioning material). In one embodiment, brass or other material inserts can be press fitted or otherwise secured into openings 156 in the bottom of the cheek piece 152, and screws 158 can secure the comb mounting bracket 154 to the cheek piece 152 via these inserts. The cheek piece 152 can be adjusted forwardly and rearwardly by aligning the screws 158 with respective openings 156 associated with the desired position of the cheek piece. The comb mounting bracket 154 can be secured to the guide post 98 and the adjustment post 100 of the adjustment apparatus 94*a* with screws 160 so that moving the adjustment post 100 inwardly and outwardly with respect to the frame 54 (when the thumb tab 128 is in the release position) will move the comb assembly 88 downwardly and upwardly, respectively. A hex key 162 also can be stored in a longitudinal bore (not shown) in the cheek piece 152, as needed, for loosening and tightening the screws 158, 160, or other screws in the buttstock assembly 50. The comb assembly 88 can be otherwise configured or omitted without departing from the disclosure.

Figure 6C:
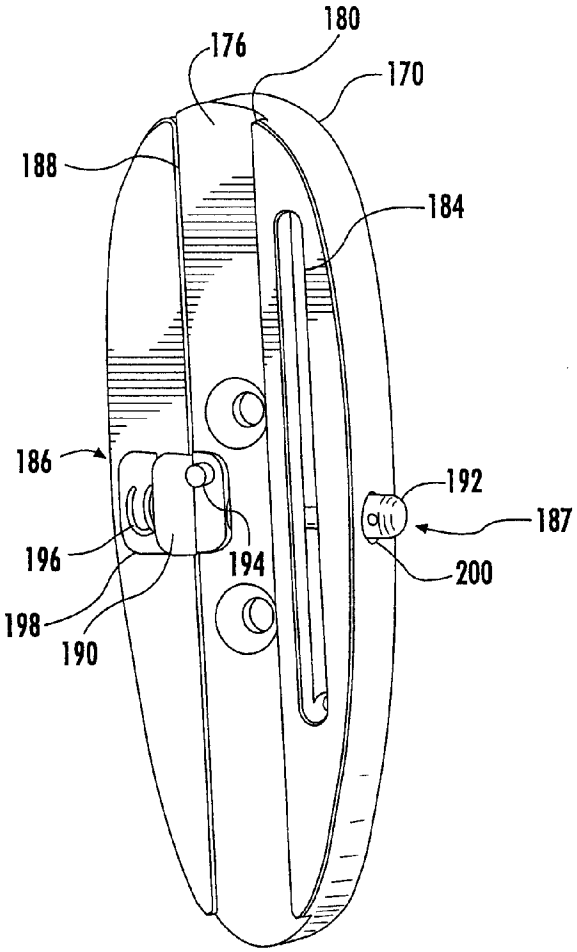
FIGS. 6B and 6C are isometric views of a base plate and a guide plate, respectively, of the butt plate assembly of FIG. 6A showing features for controlling vertical adjustment of the butt plate assembly.
Figure 6B:
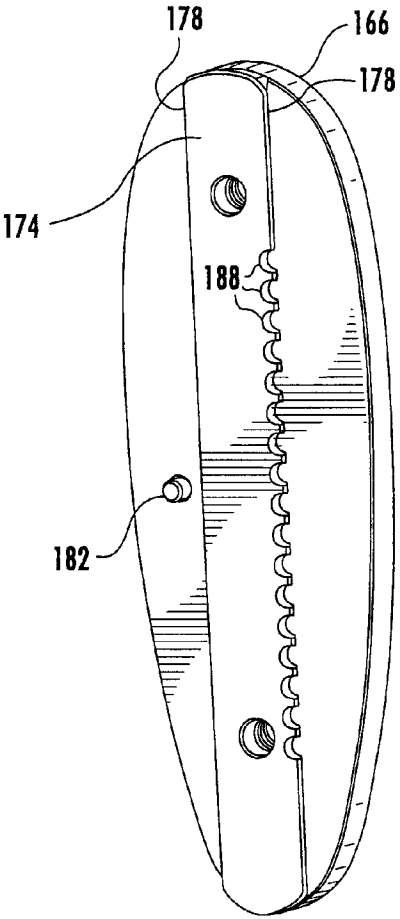

As shown in FIGS. 6A-6C, the butt plate assembly 90 includes a recoil pad 164 secured to a base plate 166 by screws 168 and a guide plate 170 secured to the guide post 98 and the adjustment post 100 of the adjustment apparatus 94*b* with screws 172. The recoil pad 164 can be made of polymer, rubber, synthetics or other materials that are comfortable for the user (e.g., a resilient cushioning material) when engaging the buttstock assembly 50 against the user's shoulder, and different size or thickness recoil pads can be easily substituted or used as needed. In addition, the recoil pad 164 is adjustably positionable in multiple directions, including in both a longitudinal or first direction and a second direction, typically vertically or otherwise transversely to the first direction as discussed below.

Figure 6D:
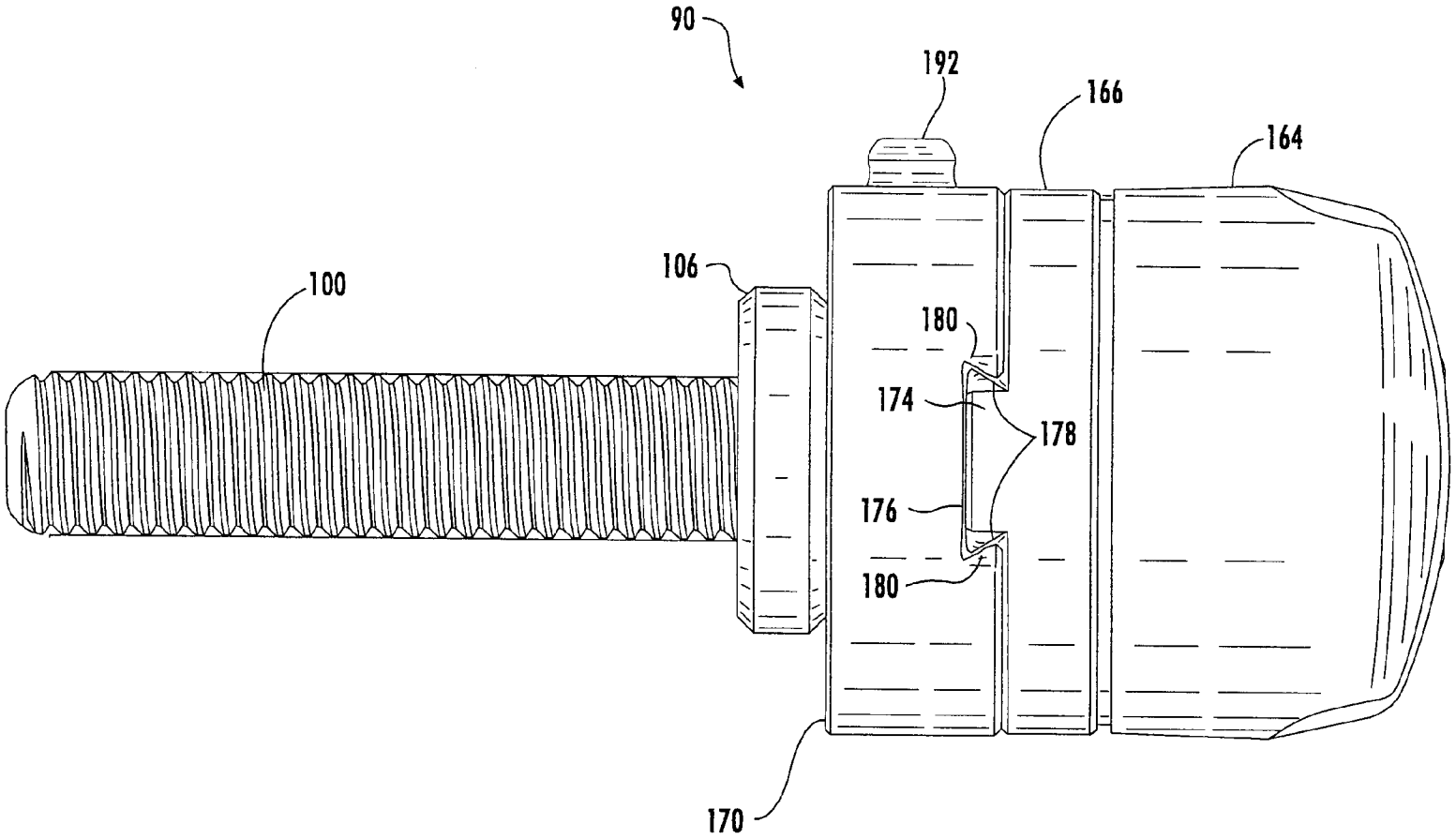
FIG. 6D is a top view of the butt plate assembly of FIG. 6A.

The base plate 166 includes a tongue feature 174 on a forward surface of the base plate, and the guide plate 170 includes a groove feature 176 on a rearward surface of the guide plate. The tongue 174 includes sloped edges 178 along the height of the base plate on either side of the tongue. Similarly, the groove 176 has sloped edges 180 along the height of the guide plate. Accordingly, the tongue 174 can be received in the groove 176 with the sloped edges 178 interfacing with the sloped edges 180 (FIG. 6D) so the tongue, and the base plate 166, can translate vertically with respect to the guide plate 170, but the tongue 174 generally will be prevented from being easily pulled out of the groove 176 in the longitudinal direction. The base plate 166 can further include an adjustment limit pin 182 integrally formed therewith or securely received (e.g., press fit) in a longitudinal bore in the base plate. The adjustment limit pin 182 can be received in an adjustment limit groove 184 in the guide plate 170 so that the adjustment limit pin 182 can slide within the adjustment limit groove 184. Accordingly, the adjustment limit pin 182 will limit the vertical translation of the recoil pad 164 and the base plate 166 relative the guide plate 170 by the length of the adjustment limit groove 184.

As shown in FIGS. 6B and 6C, the vertical translation of the recoil pad 164 and the base plate 166 further can be controlled by a pad adjustment assembly 186 provided along the guide plate 170 and which can comprise a detent mechanism 187 (FIG. 66) that engages a series of notches 188 in the tongue 174 of the base plate 166. The pad adjustment assembly 186 includes a clamp plate 190, an adjustment button 192, a clamp pin 194 or similar engaging member adapted to fit within one of the notches 188, and a biasing spring 196. The clamp plate 190 is disposed in a cut out portion 198 in the rearward surface of the guide plate 170 so that the clamp plate 190 can translate in a transverse direction, and the biasing spring 196 biases the clamp plate 190 so that a portion of the clamp plate extends into the groove 176. The clamp pin 194 projects from the clamp plate and is biased into an engaging position projecting into the groove 176 for engaging a respective notch 188 (FIGS. 6A-6B) in the tongue 174. The adjustment button 192 (FIG. 6C) extends from a side of the guide plate 170 and is in communication with the clamp plate 190 via a transversely extending bore 200 formed in the guide plate. Accordingly, the base plate 166 normally is biased to be coupled to the guide plate 170 by the engagement of the clamp pin 194 with one of the notches 188.

In the illustrated embodiment, the adjustment button 192 can be depressed to push the clamp plate 190 against the biasing spring 196 to move the clamp pin 194 toward a non-engaging position out of the groove 176. The clamp pin 194 thereby is disengaged from the notch 188. The tongue 174 then can translate up or down in the groove 176 to reposition the base plate 166 and the recoil pad 164 relative to the guide plate 170 and the frame 54. With the recoil pad 164 in a desired position, the adjustment button 192 can be released so that the biasing spring 196 urges/moves against the clamp plate 190 so as to move the clamp pin 194 back into the groove 176, toward an engaging position for engaging and being received within one of the notches 188 of the tongue 174 of base plate 166. The movement of the clamp plate 190 will move the adjustment pin 192 in the transverse bore 200 back into the original position. In one embodiment, the clamp pin 194 can fit securely in each of the notches 188 so that the clamp assembly 186 and the notches 188 can provide smooth and easy locking and unlocking of the base plate 166 and the guide plate 170 while limiting or eliminating vertical movement of the base plate 166 relative to the guide plate 170 (e.g., slack) when the clamp assembly 186 is engaged with one of the notches 188.

In one embodiment, spacer plates (not shown) also can be added to the butt plate assembly 90 to move the recoil pad 164 further rearwardly in addition to the translation of the guide post 98 and adjustment post 100 of the adjustment apparatus 92*b*. The butt plate assembly 90 can be otherwise configured or omitted without departing from the disclosure.

In operation, the vertical position of the comb assembly 88 and/or the longitudinal spacing of the butt plate assembly 90 can be adjusted by releasing the throw lever assemblies 94 so that the guide post 98 and the adjustment post 100 can translate relative to the frame 54. Particularly, the actuating end 148 of the lever lock 132 can be depressed to disengage the lock end 146 of the lever lock from the notch 150 in the head 126 of the cross pin 122. The thumb tab or lever thereof 128 then can be pivoted upwardly about the pivot pin 130 and the head 126. The cam lobes 136 rotate as the thumb tab 128 is pivoted, and the cam surfaces 142 slide along the indentations 144 in the lever lock plate 116. Accordingly, the distance between the pivot pin 130 and the portions of the cams surfaces 142 in contact with the lever lock plate 116 decreases as the thumb tab 128 is pivoted to the release position. In one embodiment, the pivot pin 130 is spaced apart from the lever lock plate 116 by the distance D1 (FIG. 4) when the thumb tab 128 is in the release position. With the thumb tab 128 in the release position, the clamping force on the deflection portions 112, 114 of the frame 54 is reduced or eliminated, reducing the friction between the frame and the guide post 98 and the adjustment post 100 at the respective bores 102, 104. Accordingly, the adjustment wheel 106 can be turned to move the adjustment post 100 inwardly or outwardly of the frame, moving the comb assembly 88 or the butt plate assembly 90.

Once the comb assembly 88 and/or the butt plate assembly 90 has been adjusted to a desired position, the respective throw lever assembly 94 of the adjustment apparatus 92*a* or 92*b* thereof can be moved to the lock position to secure the guide post and the adjustment post. Particularly, the thumb tab 128 can be pivoted to the lock position (FIGS. 2A and 4), pivoting the cam lobes 136 so that the pivot pin 130 is spaced apart from the lever lock plate 116 by the distance D1 (FIG. 4). The lock end 146 of the lever lock 132 can engage the notch 150 in the head 126 of the cross pin 122 when the thumb tab 128 is in the lock position to help retain the thumb tab in the lock position. In the lock position, the cam lobes 136 bear downwardly on the lever lock plate 116 and the cross pin 122 pulls upwardly on the nut 124, which bears on the locking nut plate 118. The deflection portions 112, 114 are squeezed between the lever lock plate and the locking nut plate, narrowing the slit 96 and closing/tightening the frame 54 around the guide post 98 and the adjustment post 100. Accordingly, the throw lever assemblies 94 help lock the guide post 98 and the adjustment post 100 in position.

In the illustrated embodiment, a latch mechanism 202 for the foldable buttstock assembly 50, can be provided, being operable to selectively enable pivoting of the buttstock assembly 50 between an extended configuration (FIG. 1A) and a folded configuration (FIG. 1B). In the extended position shown in FIG. 1A, the buttstock assembly 50 extends rearwardly from the rear end 26 of the chassis 10, in line with the chassis 10, enabling the firearm to be operated. In the folded configuration, the buttstock assembly 50 extends forwardly from the rear end 26 of the chassis 10, substantially parallel to the chassis 10, and is secured to a lateral side of the chassis 10, thereby reducing the length of the firearm F to facilitate transporting the firearm. The latch mechanism can comprise a variety of stock latching systems for securing the buttstock assembly in its extended and folded configuration as needed. For example, a latch mechanism as disclosed in U.S. patent application Ser. No. 12/640,531, the disclosure of which is incorporated as if fully set forth herein, can be used.

FIGS. 7A and 7B are isometric views of the frame 54 with clamping mechanisms for tightening the frame 54 about the guide post 98 and/or the adjustment post 100 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIGS. 7A and 7B, each of the adjustment apparatus 92*a*', 92*b*' includes a screw clamp assembly 94'. Each screw clamp assembly 94' includes a pair of clamp plates, including a first or screw lock plate 116' disposed in the relief cut 108 and a second or screw nut plate 118' in the relief cut 110. Each of the screw lock plate 116' and the screw nut plate 118' includes a bore that is aligned with the through bore 120 of the deflection portions 112, 114 of the frame 54. The bore in the screw nut plate 118' can be threaded to engage an adjustable fastener such as a cross screw 122', which can be inserted into the bore 120 from the right side of the firearm F.

In an alternative embodiment, the bore in the screw nut plate 118' can be a clearance fit with the cross screw 122', and a nut (not shown) can engage the cross screw at the bore in the screw nut plate. The screw clamp assemblies 94' can be easily switched so that the screw lock plate 116' is disposed in the relief cut 110 on the left side of the firearm, the screw nut plate 118' is disposed in the relief cut 108 on the right side of the firearm, and the cross screw 122' is inserted into the bore 120 from the left side of the firearm. The cross screws 122' can be configured to be tightened and loosened by a screwdriver, a hex key (e.g., hex key 162), or other tool. The screw clamp assemblies 94' could be otherwise shaped, arranged, and/or configured without departing from the disclosure.

In operation, the vertical position of the comb assembly 88 and/or the longitudinal spacing of the butt plate assembly 90 can be adjusted by loosening the respective cross screw 122' so that the guide post 98 and the adjustment post 100 can translate relative to the frame 54. The adjustment wheel 106 can be turned to move the adjustment post 100 inwardly or outwardly of the frame, moving the comb assembly 88 or the butt plate assembly 90 accordingly. With the comb assembly 88 and/or the butt plate assembly 90 in a desired position, the respective cross screw can be tightened (e.g., with a hex key). The tightening of the cross screw 122' causes the head of the screw to bear against the screw lock plate 116' as the end portion of the cross screw that is threadedly engaged with the screw nut plate 118' urges the screw nut plate 118' toward the screw lock plate 116'. As these clamp plates are drawn together, the deflection portions 112, 114 are urged toward one another between the screw lock plate and the screw nut plate, narrowing the slit 96 and closing/tightening the frame 54 around the guide post 98 and the adjustment post 100. Accordingly, the screw clamp assemblies 94' help lock the guide post 98 and the adjustment post 100 in position until the cross screws 122' are loosened.

It therefore can be seen that the construction of the firearm with an adjustable modular buttstock assembly according to the principles of the present disclosure provides a firearm with a lightweight yet highly configurable buttstock assembly while further providing for substantially quick and easy adjustment and reconfiguration of features of the buttstock assembly.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

The invention claimed is:

1. An adjustable buttstock assembly for a firearm, comprising:

a skeletonized frame comprising a body extending about and defining an open space therethrough;

a comb assembly and a recoil pad assembly mounted along the frame;

a first adjustment apparatus connected to the comb assembly for adjustment of a position of the comb assembly with respect to the frame, the first adjustment apparatus comprising a first post received within and moveable through a first bore formed in the frame and a lock mechanism operable to urge the frame into engagement with the first post to lock the first post in a desired position with respect to the frame; and a second adjustment apparatus connected to the recoil pad assembly for adjusting a position of the recoil pad assembly with respect to the frame, the second adjustment apparatus comprising a second post received within and moveable through a second bore formed in the frame.

2. The adjustable buttstock assembly of claim 1, wherein the lock mechanism of the first adjustment apparatus comprises a screw clamp or a screw fastener.

3. The adjustable buttstock assembly of claim 1, further comprising a separation channel formed adjacent each of the first and second bores through which the respective first and second posts are received, wherein the lock mechanism is a first lock mechanism of the first adjustment apparatus, the second adjustment apparatus comprises a second lock mechanism, and each of the first and second lock mechanisms comprises a clamping mechanism mounted along the frame adjacent the respective separation channel, wherein upon actuation of each clamping mechanism the frame is urged into frictional engagement with the respective first and second posts of the respective first and second adjustment apparatus.

4. The adjustable buttstock assembly of claim 1, wherein the first post or the second post comprises an adjustment post received within and movable through the first bore or the second bore formed in the frame, and the first adjustment apparatus or the second adjustment apparatus further comprises a guide post received within and moveable through an additional bore formed in the frame.

5. The adjustable buttstock assembly of claim 4, wherein the first adjustment apparatus or the second adjustment apparatus further comprises an adjustment wheel mounted along the adjustment post and rotatable so as to enable a user to move the adjustment post through the first or second bore.

6. The adjustable buttstock assembly of claim 4, further comprising a separation channel formed adjacent and in communication with the first bore and the additional bore through which the respective adjustment post and guide post are received, wherein the lock mechanism comprises a clamping mechanism mounted along the frame adjacent the separation channel, and wherein upon actuation of the clamping mechanism, the frame is urged into frictional engagement with at least one of the adjustment post or the guide post of the first adjustment apparatus.

7. The adjustable buttstock assembly of claim 1, further comprising at least one rail platform mounted to the frame.

8. The adjustable buttstock assembly of claim 1, and further comprising a bracket mountable within the open space defined by the frame for attaching an accessory to the frame.

9. The adjustable buttstock assembly of claim 1, wherein the lock mechanism of the first adjustment apparatus can be removed and mounted on an opposite side of the frame to enable ambidextrous operation thereof.

10. The adjustable buttstock assembly of claim 1, wherein the lock mechanism of the first adjustment apparatus comprises a pair of clamp plates mounted on opposite sides of a separation channel formed along the frame adjacent the first adjustment apparatus and in communication with the first bore formed in the frame, and an adjustable fastener extending through the clamp plates and the frame, wherein the fastener is engaged to draw the clamp plates together, closing the separation channel such that the frame is brought into engaging contact with the first post of the first adjustment apparatus.

11. The adjustable buttstock assembly of claim 1, wherein the recoil pad assembly comprises a guide plate connected to the frame by the second post of the second adjustment apparatus and a recoil pad moveably positioned along the guide plate, wherein the guide plate is adjustable in a first direction with respect to the frame and the recoil pad is adjustable in a second direction with respect to the guide plate.

12. The adjustable buttstock assembly of claim 11, further comprising a base attached to the recoil pad, and a detent mechanism mounted along the guide plate and having an engaging member moveable between a non-engaging position and an engaging position for engaging one of a plurality of notches formed along the base to enable selective adjustment of the recoil pad in the second direction.

* * * * *